United States Patent [19]

Summers

[11] 4,433,205

[45] Feb. 21, 1984

[54] COMPRESSIVE CABLE CONNECTOR

[76] Inventor: John E. Summers, P.O. Box 5433, Charlotte, N.C. 28225

[21] Appl. No.: 238,738

[22] Filed: Feb. 27, 1981

Related U.S. Application Data

[63] Continuation-in-part of Ser. No. 31,423, Apr. 19, 1979, abandoned.

[51] Int. Cl.[3] ..... H01R 4/20

[52] U.S. Cl. ..... 174/84 C; 29/871; 339/97 R; 339/276 R

[58] Field of Search ..... 29/871, 869, 882, 276 R; 339/97 R, 205, 276 R, 95 R; 174/90, 84 C

[56] References Cited

U.S. PATENT DOCUMENTS

| | | | |
|---|---|---|---|
| Re. 26994 | 12/1970 | Fuller et al. | 339/97 R X |
| 2,291,434 | 7/1942 | Hollopeter et al. | 339/205 X |
| 2,753,392 | 7/1956 | Hebeler | 339/97 R |
| 3,553,347 | 1/1971 | Harding et al. | 174/84 C |
| 3,814,836 | 6/1974 | Neale, Sr. | 174/90 X |

FOREIGN PATENT DOCUMENTS

| | | | |
|---|---|---|---|
| 1367540 | 9/1974 | United Kingdom | 339/276 R |

*Primary Examiner*—Howard N. Goldberg
*Assistant Examiner*—Carl J. Arbes
*Attorney, Agent, or Firm*—Clifton Ted Hunt

[57] ABSTRACT

A cable connector is provided which is particularly adapted for use in the field whereby the connection may be quickly and reliably made without the use of special tools other than those ordinarily carried by welders and electricians, such as screwdrivers, knives and hammers. The connector comprises a length of copper tubing having an inside diameter slightly larger than the outside diameter of the cable to be connected. The copper tubing is slotted along its length to define deformable portions which are forced into the cable strands after the ends of the cable to be connected have been inserted into abutting relation through opposite ends of the tube.

2 Claims, 6 Drawing Figures

COMPRESSIVE CABLE CONNECTOR

CROSS REFERENCE TO RELATED APPLICATIONS

This application is a continuation-in-part of Ser. No. 31,423 filed Apr. 19, 1979 and now abandoned and entitled Compressive Cable Connector.

BACKGROUND OF THE INVENTION

Cable connectors for heavy duty electrical cables have long been known. See, for example, U.S. Pat. No. 461,868, issued Oct. 27, 1891 to J. H. Fleming which discloses a cable connector comprising a metallic coupling sleeve within which the wires of cables to be connected are inserted from opposite ends. After the wires are inserted within the metallic sleeve, the sleeve is deformed by bending the sleeve and the inserted wires simultaneously to define alternate shoulders on opposite sides of the sleeve. The wires are shaped in close correspondence with the shoulders and remain in close engagement at all points within the sleeve. In Fleming the shoulders are preferably formed by a bending tool having a series of alternating fingers or bending projections, but Fleming discloses that the projections may be formed by means of ordinary pliers or other tools.

It is with a metallic sleeve connector of the type disclosed in Fleming with which the present invention is particularly concerned. Other patents disclosing cable connectors and known to applicant are: U.S. Pat. Nos. 1,858,284 issued May 17, 1932 to Horace Schwartz; 1,998,518 issued Apr. 23, 1935 to Joseph L. Mraz; 2,276,140 issued Mar. 10, 1942 to K. H. Andren; 2,375,741 issued May 8, 1945 to Bern Dibner; 2,672,596 issued Mar. 16, 1954 to Theodore J. Grypma; 2,907,814 issued Oct. 6, 1959 to Edward S. Raila et al; 2,917,569 issued Dec. 15, 1959 to Robert Senior, Jr.; 3,040,292 issued June 19, 1962 to Arthur A. Bernard; 3,500,296 issued Mar. 10, 1970 to Michael F. O'Keefe et al; 4,087,889 issued May 9, 1978 to Shintaro Ohba et al. 3,978,899 issued Sept. 7, 1976 to Theodor Schroder does not disclose a cable connector but it is of interest as disclosing the slitting of metal to define deformable portions.

SUMMARY OF THE INVENTION

The cable connector of the present invention is particularly intended for use with heavy duty cables such as welding cables, and comprises a metallic sleeve dimensioned to fit over the stripped proximal ends of abutting cable ends sufficiently to make a good mechanical and electrical connection between the sleeve and the cable ends when joined together. A length of about four inches has been found sufficient for this purpose but it is noted that the length is not critical. According to the invention, the ends of the cable to be connected are stripped of their insulation as in the prior art and the stripped ends are then inserted into opposite ends of the metallic sleeve and extend toward each other within the sleeve into abutting relation. The invention as thus far disclosed is substantially the same as disclosed in the aforesaid U.S. Pat. No. 461,868 to James H. Fleming.

It is an important feature of this invention that that metallic sleeve be preformed to define a plurality of radially deformable portions spaced from each other along the longitudinal axis of the sleeve prior to the association of the metallic sleeve with the cable ends.

After the stripped cable ends are inserted into opposite ends of the metallic sleeve, the sleeve is joined to the cable ends by radially deforming each deformable portion while simultaneously and correspondingly radially deforming the stripped cable ends.

The deformable portions in the metallic sleeve are preferably arranged in alternating offset relation to each other on opposite sides of the sleeve. It is intended that the deformable portions and the underlying cable ends will be simultaneously radially deformed by placing a screwdriver or the like against the deformable portions, in turn, and striking it with a hammer or the like. The deformable portions of the sleeve are thereby moved radially toward the axis of the sleeve and the underlying cables are simultaneously moved into a sinuous path within the sleeve.

The displaced portions of the sleeve define retaining shoulders which effectively prevent the cable from being pulled from the sleeve in ordinary use. At the same time, the displaced portions of the sleeve are integrally joined with the cable ends to provide an effective electrical connection.

It is an object of this invention to provide a cable connector of the type disclosed which advantageously results in the connection of cables being made in the field without special tools.

It is another object of this invention to provide a cable connector of the type disclosed which provides a sufficiently strong mechanical connection between the two cables to withstand the tension and stresses inherent in dragging heavy cables over rough terrain and objects.

It is still another object of this invention to provide a cable connector of the type disclosed which will quickly and efficiently unite two cable ends with a strong electrical connection whereby electrical current will flow freely through the connection.

DETAILED DESCRIPTION OF THE INVENTION

Figures 1, 2, 3, 4, 5:
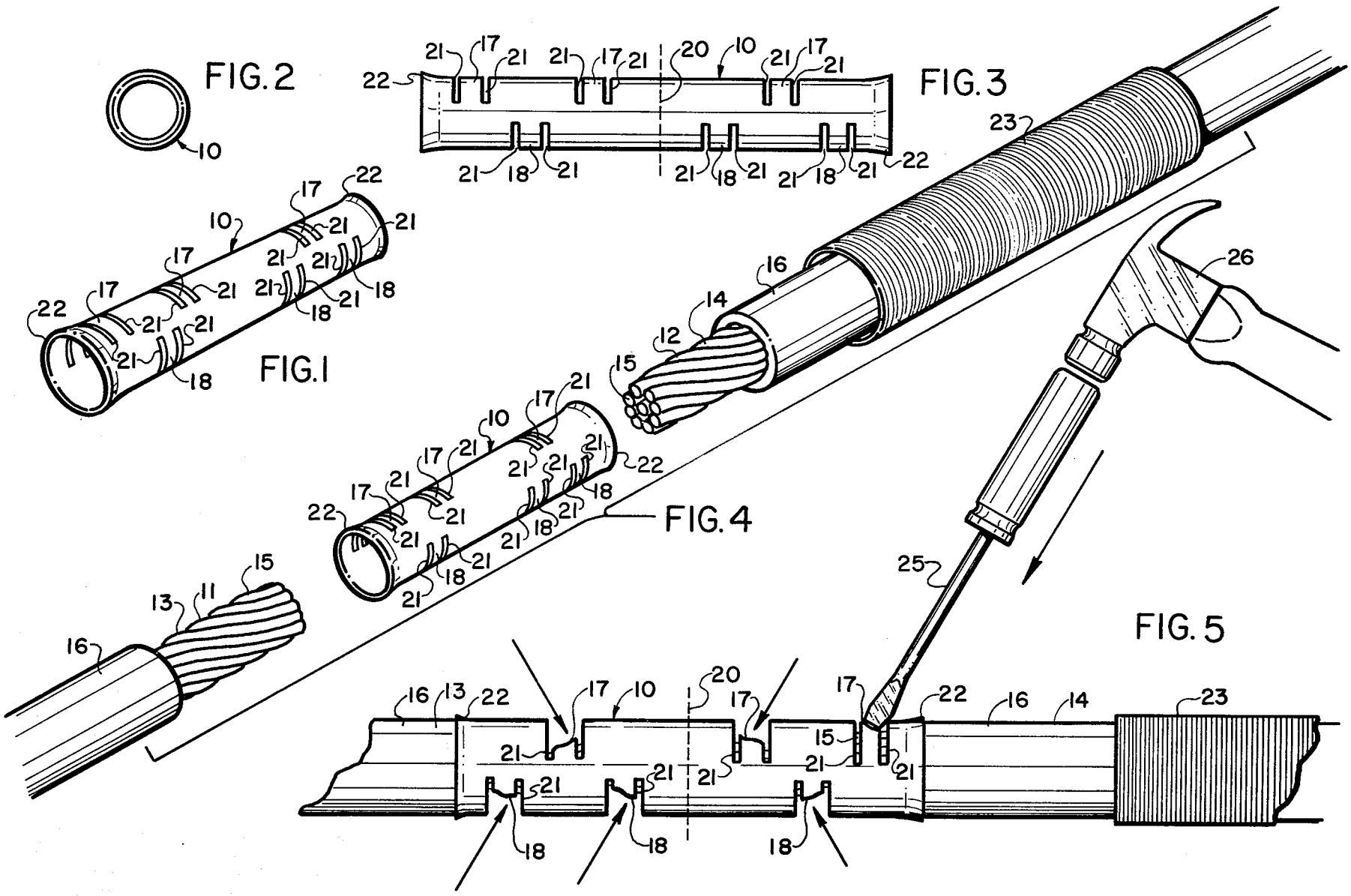
FIG. 1 is a perspective view of the preformed metallic sleeve.
FIG. 2 is an end view of the metallic sleeve shown in FIG. 1.
FIG. 3 is a side elevation of the metallic sleeve shown in FIG. 1.
FIG. 4 is an exploded view illustrating the preliminary positioning of heat shrinkable insulation material and the positioning of cable ends within the sleeve preparatory to joining the sleeve to the cable ends.
FIG. 5 is a side elevation of the assembled sleeve and cable ends with the heat shrinkable insulation in its preliminary position and illustrating the radially inward deformation of the deformable portions of the sleeve to complete the connection.

Referring more specifically to the drawings, the numeral 10 broadly indicates the metallic sleeve, preferably made of an electrically conductive material such as copper. The sleeve 10 is dimensioned to snugly receive the stripped ends 11 and 12 of heavy duty electric cables 13 and 14 comprising one or more electrically conductive wires 15 and an insulating jacket 16. The cables 13 and 14 are large diameter cables such as customarily used in welding and approximaing the diameter of a person's finger.

According to the invention, a first series of deformable portions 17 are formed in axially spaced relation to each other on one side of the sleeve 10 and a second group of deformable portions 18 are formed in spaced axial relation to each other on the opposite side of the sleeve 10. It will be noted in the drawings that the deformable portions 18 are offset relative to the portions 17 and that the deformable portions 17 and 18 are shown as being arranged in groups of three on each side of the transverse centerline 20 of sleeve 10. Any number of deformable portions may be provided within the scope of the invention but it has found satisfactory to provide groups of three portions with one portion on the opposite side of the sleeve offset in relation to the two portions on the same side of the sleeve.

In the illustrated embodiment of the invention the portions 17 and 18 are defined by slots 21 extending transversely into the sleeve 10 at the axially spaced margins of their respective deformable portions 17 and 18. The slots 21 extend radially into the sleeve and preferably terminate adjacent the longitudinal axis of the sleeve, as best seen in FIG. 2, although the radial dimension of the slots 21 is not critical. The slots 21 are arranged in pairs, each pair defining a deformable portion 17 or a deformable portion 18.

Figure 6:
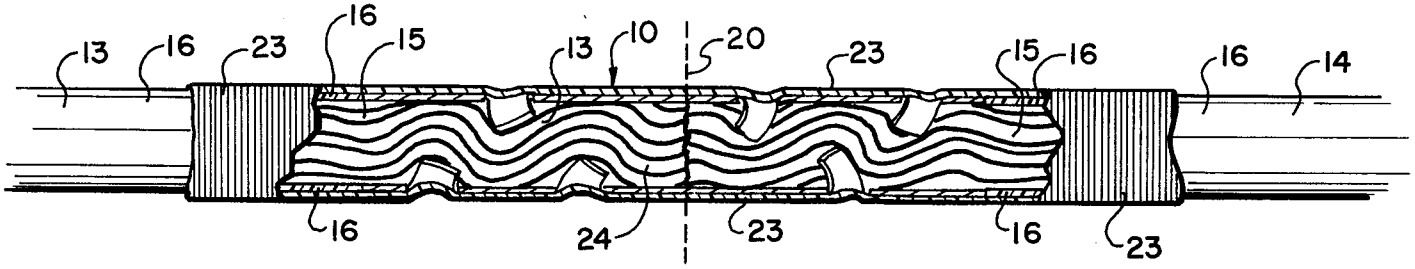
FIG. 6 is a view similar to FIG. 5 but showing the completed assembly after the heat shrinkable insulation has been drawn over the metallic sleeve and shrunk into snug engagement with the sleeve and the proximal insulated portions of the cables.

Each end of the sleeve 10 is flared outwardly as at 22 to facilitate insertion of the stripped ends 11 and 12 within the sleeve 10. Before inserting the cable ends 11 and 12 in the sleeve 10, a heat shrinkable electric insulation cover of tubular configuration and indicated at 23 is drawn past one end of the cable to a preliminary position and is illustrated in FIGS. 4 and 5 as having been drawn onto cable end 14 prior to the stripped end 12 being inserted into one end of sleeve 10 and the stripped end 11 being inserted into the other end of sleeve 10. After the ends 11 and 12 are positioned within sleeve 10, the assembly is placed on the ground or other surface suitable for supporting the assembly against impact and the deformable portions 17 and 18 are sequentially moved radially inwardly while simultaneously and correspondingly reorienting the underlying cable 15 into the sinuous path indicated at 24 in FIG. 6.

Any convenient means may be used to move the deformable portions 17 and 18 radially inwardly to the operative positions shown in FIG. 5. A screwdriver 25 is illustrated as being hit by a hammer 16 to upset one of the deformable portions 17 and simultaneously reorient the cable 15 therebeneath.

After all of the deformable portions 17 and 18 have been upset the underlying cable 15 is reoriented into the sinuous path 24 within sleeve 10 and the cable 15 is snugly engaged by the tube 10 throughout its length thereby providing maximum electrical connection and a firm and reliable mechanical connection.

The tubular insulating jacket 23 is then moved axially along cable 14 to overlie sleeve 10, after which it is subjected to heat as from a blow torch to shrink it snugly about the sleeve 10 and the proximate insulating jacket 16 on the cable ends 13 and 14. The resulting connection is mechanically and electrically sound and the insulating jacket 23 electrically insulates the connection and provides a waterproof covering. The connection made according to the invention withstands rough use and resists tensional stresses occasioned in traversing rough terrain, building elements and the like.

In the drawings and specification there has been set forth a preferred embodiment of the invention and although specific terms are employed they are used in a descriptive and generic sense only and not for purpose of limitation.

I claim:

1. A cable connector for joining together two ends of malleable metal cable, said cable connector comprising a sleeve formed from malleable metal and having an axis and a smooth inner surface, said sleeve including a plurality of deformable portions formed in axially spaced relation to each other on one side of the axis of the sleeve and defined along the corresponding surface of the sleeve by slots extending radially from said corresponding surface of the sleeve toward the axis of the sleeve at the axially spaced margins of their respective deformable portions; whereby the two ends of cable may be pushed into opposite ends of the sleeve toward abutting relation with each other and subjacent the series of deformable portions, after which the deformable portions of the sleeve and the malleable metal cable subjacent thereto may be reoriented inwardly toward the axis of the sleeve.

2. A structure according to claim 1 including a second series of deformable portions formed in axially spaced relation to each other on the side of the sleeve opposite said one side and defined by slots extending radially from said opposite side of the sleeve toward the axis of the sleeve at the axially spaced margins of their respective deformable portions, and the deformable portions on said opposite side of the sleeve being arranged in off-set relation to the deformable portions on said one side of the sleeve; whereby the two ends of cable within the sleeve may be reoriented inwardly toward the axis of the sleeve to define a sinuous configuration of the cable ends within the sleeve.

* * * * *